US007056632B2

(12) United States Patent
Ioannidis

(10) Patent No.: US 7,056,632 B2
(45) Date of Patent: Jun. 6, 2006

(54) SOLUTION-COATABLE, THREE-COMPONENT THIN FILM DESIGN FOR ORGANIC OPTOELECTRONIC DEVICES

(75) Inventor: Andronique Ioannidis, Webster, NY (US)

(73) Assignee: Xerox Corporatioin, Stamford, CT (US)

( * ) Notice: Subject to any disclaimer, the term of this patent is extended or adjusted under 35 U.S.C. 154(b) by 417 days.

(21) Appl. No.: 10/347,231

(22) Filed: Jan. 21, 2003

(65) Prior Publication Data

US 2004/0142257 A1 Jul. 22, 2004

(51) Int. Cl.
*G03G 5/06* (2006.01)
*G03G 15/00* (2006.01)

(52) U.S. Cl. ..... 430/56; 430/73; 430/74; 430/78; 430/79; 430/135; 430/48; 399/159; 427/447; 252/511; 252/519.3; 252/589

(58) Field of Classification Search ..... 252/511, 252/519.3, 589; 106/1.11; 427/447, 430.1; 430/56, 73–74, 78–79, 58.6–59.6, 133, 135, 430/48; 399/159
See application file for complete search history.

(56) References Cited

U.S. PATENT DOCUMENTS

| | | | | |
|---|---|---|---|---|
| 4,122,113 | A * | 10/1978 | Turner | 558/414 |
| 4,265,990 | A | 5/1981 | Stolka et al. | |
| 5,315,129 | A | 5/1994 | Forrest et al. | |
| 5,324,610 | A * | 6/1994 | Tanaka et al. | 430/83 |
| 5,399,452 | A * | 3/1995 | Takegawa et al. | 430/59.6 |
| 5,525,447 | A | 6/1996 | Ikuno et al. | |
| 6,130,001 | A | 10/2000 | Shi et al. | |
| 6,190,818 | B1 | 2/2001 | Ioannidis et al. | |
| 6,198,092 | B1 | 3/2001 | Bulovic et al. | |
| 6,245,471 | B1 * | 6/2001 | Levin et al. | 430/58.4 |
| 6,278,055 | B1 | 8/2001 | Forrest et al. | |
| 6,297,495 | B1 | 10/2001 | Bulovic et al. | |
| 6,326,112 | B1 * | 12/2001 | Tamura et al. | 430/58.7 |
| 6,586,148 | B1 * | 7/2003 | Graham et al. | 430/58.65 |
| 2004/0085619 | A1 * | 5/2004 | Wu et al. | 359/296 |

FOREIGN PATENT DOCUMENTS

JP 09-197692 A * 7/1997

* cited by examiner

*Primary Examiner*—Mark Kopec
*Assistant Examiner*—Kallambella Vijayakumar
(74) *Attorney, Agent, or Firm*—Oliff & Berridge, PLC

(57) ABSTRACT

An organic optoelectronic device includes a solution coatable thin film having a hole transporting material, an electron transporting material, and a photogenerating component uniformly dispersed therein. The thin film is about 0.2 microns or less, and can be spin-coated onto a substrate and further coated with electrodes.

17 Claims, 1 Drawing Sheet

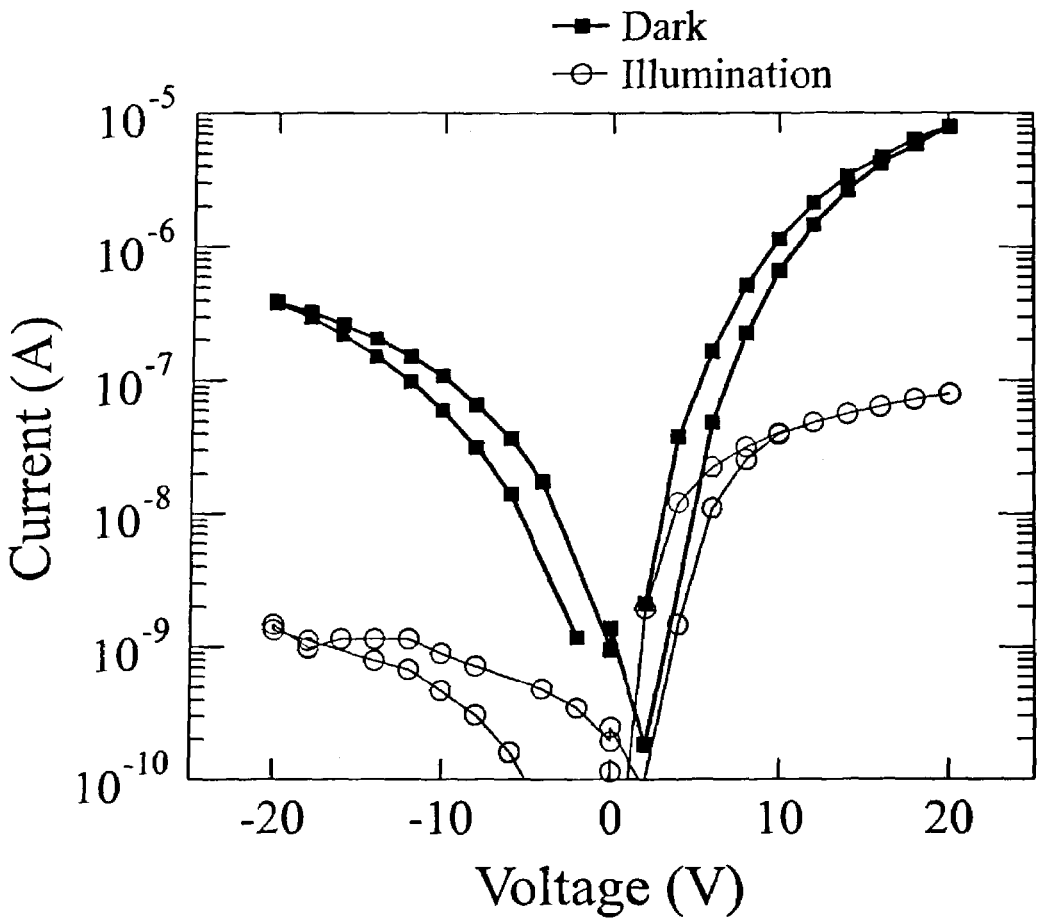
Dark
Illumination
Current (A)
10^-5
10^-6
10^-7
10^-8
10^-9
10^-10
-20
-10
0
10
20
Voltage (V)

SOLUTION-COATABLE, THREE-COMPONENT THIN FILM DESIGN FOR ORGANIC OPTOELECTRONIC DEVICES

BACKGROUND OF THE INVENTION

1. Field of Invention

This invention relates to organic electronic devices, and more specifically to, organic electronic devices having a single thin layer comprising three functionally optimized components uniformly dispersed therein.

2. Description of Related Art

A photoconductive layer for use in electrophotography may be a single layer or it may be a composite layer. One type of composite photoconductive layer used in xerography is illustrated in U.S. Pat. No. 4,265,990, incorporated by reference in its entirety herein, which describes a photosensitive member having at least two electrically operative layers (i.e., a dual layer photoreceptor structure). One layer comprises a photoconductive layer that is capable of photogenerating holes and injecting the photogenerated holes into a contiguous charge transport layer. Generally, where the two electrically operative layers are supported on a conductive layer, the photoconductive layer is sandwiched between the contiguous charge transport layer and the supporting conductive layer. In another embodiment, the charge transport layer is sandwiched between the supporting electrode and a photoconductive layer.

Photosensitive members, e.g., photoreceptors, having at least two electrically operative layers as described above, provide excellent images when charged with a uniform electrostatic charge, exposed to a light image and thereafter developed with finely developed electroscopic marking particles. A key component of modem photoreceptors is the charge generation layer (CGL) which absorbs imaging light and produces the conducting charge that is used to discharge the charge on the photoreceptor surface and hence form an electrostatic image. For reasons of electrical performance and cycling stability, it is desirable that such a charge generation layer be as thin as possible, yet absorb more than 90 percent of the light to which it is exposed. Thus, it is desirable to coat a charge generation layer to a thickness of about 0.1 micrometer to about 0.2 micrometer (100 nanometers to 200 nanometers) taking into account the binder polymer.

Organic electronic devices are typically dual layer structures having a junction formed between the two layers. Such a junction usually determines the responsiveness of the device and is dependent upon how well the contact between the two layers is controlled, the specific material composition, and the like. Production of these junctions often involves using vapor or vacuum deposition of the active species.

In order to increase the efficiency of organic electronic devices, it is desirable to have an interface or junction between the two layers to produce the smallest possible obstruction to free current flow, i.e., have the smallest possible resistance at the junction.

Ideally, the optoelectronic functionality would exist in a single layer without a junction as an additional variable. However, a single layer would have to be very thin, at least about 200 nm or less, in order to provide a sufficient field at desired low operating voltages in order to enable current flow.

SUMMARY OF THE INVENTION

In exemplary embodiments of the present invention, an organic electronic device comprises a single solvent cast layer forming multiple junctions and uniformly dispersed therein at least one of each of a hole transporting functional component, an electron transporting functional component and a photogenerating component.

Exemplary embodiments of the present invention exhibit enhanced photoresponsiveness by, for example, adding a photogenerating component to a bipolar transport matrix dissolved in a common polymer binder.

The reliability of such organic electronic devices according to exemplary embodiments of the present invention is improved by reducing and/or eliminating heterojunctions as found in dual layer structures.

Such organic electronic devices of exemplary embodiments of the present invention may be of about 0.2 microns or less, and be solution coatable.

BRIEF DESCRIPTION OF THE DRAWINGS

The Figure is a graph of current versus voltage of an exemplary embodiment of the present invention.

DETAILED DESCRIPTION OF PREFERRED EMBODIMENTS

Exemplary embodiments of the present invention include an organic optoelectronic device comprising a thin film coated solution layer sandwiched between a substrate and an overcoat layer.

A first electrode, in exemplary embodiments, may serve as a substrate upon which the thin film is coated, and serves as a hole injecting anode. The thin film coated solution is preferably coated on the first electrode, upon which is then preferably laminated a second electrode, serving as an electron injecting electrode. Of course, the first electrode may be electron injecting and the second electrode may be hole injecting.

As the electrodes/contacts, any suitable types of materials may be used. Each electrode may comprise either a single layer or multiple layers. As long as one electrode is hole injecting and one electrode is electron injecting, then the device will work.

Preferably, there is a workfunction difference between the two contacts, and in fact, the larger the workfunction difference, the better the performance of the device may be. This workfunction difference may thus aid in the performance of the multi-component single layer organic device of the present invention. The actual injection performance of the contacts, however, will still depend on the particular ionization potentials of the materials chosen for the single layer.

Any metal-containing material for top and bottom contacts that exhibit workfunction differences between top and bottom contacts of, for example, 0.4 eV to 3 eV, may be used without limitation. Mention may be made of Al, Au, Pt, Ca, indium tin oxide (ITO), etc., possibly coated upon a substrate such as glass or other material.

In exemplary embodiments of the present invention, the thin film layer has dispersed therein at least one of each of hole transporting molecules, electron transporting molecules and photogenerating molecules in a single, uniform dispersion layer. That is, each of the components are preferably substantially uniformly dispersed throughout the entirety of the thin film layer. The thin film is preferably about 0.2 microns or less in thickness.

Efficiency of such photoresponsive layers is highly dependent upon the thickness of such layers. That is, typically, as adsorption drops as the layer is made thinner, so too does efficiency tend to decrease as the layer is made progressively thinner. However, it is preferred to provide as thin of a layer as possible to ensure adequate field at low voltages and support continuous current flow.

In exemplary embodiments, the hole transporting functional component, the electron transporting functional component and the photogenerating component have optimal functionality, are compatible with each other and function in a uniform, thin film coating of about 0.2 microns or less.

The hole transporting functional component may be of any known or future developed hole transporting functional component. The hole transporting functional component, e.g., hole transport molecules, are typically arylamines that have an electron donating functionality. The functional moiety in such molecules is the arylamine. In exemplary embodiments, the hole transporting functional component may be, for example, N,N'-diphenyl-N,N'-di(m-totyl)-p-benzidine (mTDB), tri-p-tolylamine (TTA), N,N'-diphenyl-N,N'-bis(3-methylphenyl)-1,1'-biphenyl-4,4'-diamine (TPD), a triphenylamine hole-transporting functional component (AE-18), and mixtures thereof.

The electron transporting functional component may be any known or future developed electron transporting functional component. The electron transporting functional component, e.g., electron transport molecules, are electron acceptors. The electron transporting functional component of the thin film in exemplary embodiments of the present invention may be, for example, carboxyphenylnaphthaquinone (NQN), t-butyl diphenoquinone (DPQ), any of:

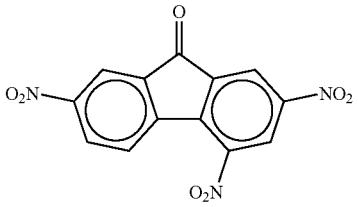

TNF

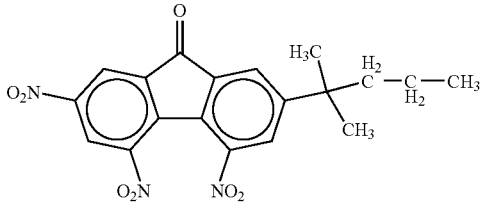

DBTNF

-continued

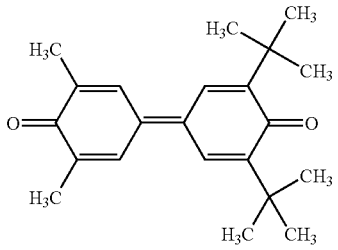

DMDB

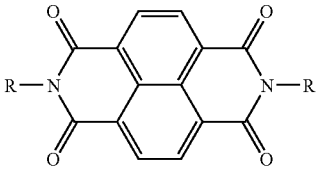

NTDI (wherein R in NTDI may be any suitable group including, without limitation, H, alkyl, aryl, etc.)

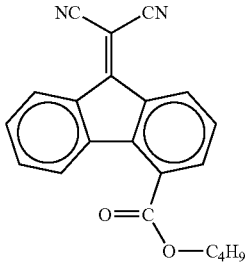

BCFM (butylcarboxylate fluorenone malononitrile, CAS# 93376-18-2)

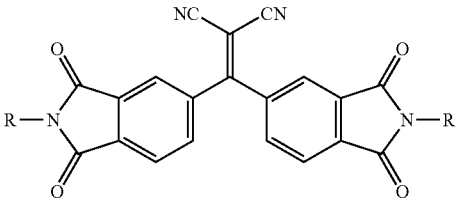

BIB-CNs (1,1-(N,N'-bisalkyl-bis-4-phthalimido)-2,2-bis-cyano-ethylenes) (wherein R in the BIB-CNs may be any suitable group, preferably an alkyl group such as, for example, methyl, ethyl, isopropyl, butyl (i-, n- or s-), 1,2-dimethylpropyl, hexyl, 2-ethylhexyl, cyclohexyl, 3-methoxypropyl, phenethyl, etc.); 2-ethylhexylcarboxylate fluorenone malononitrile (2EHCFM), and mixtures thereof.

The photogenerating component of exemplary embodiments of the present invention can be any photogenerating pigment or dye, or mixtures thereof. Examples of photogenerating components in exemplary embodiments include a dispersion of metal-free phthalocyanine, titanyl phthalocyanine (TiOPc), hydroxygallium phthalocyanine (OHGaPc), chlorogallium phthalocyanine (ClGaPc) and benzimidazole perylene (BZP).

It is preferred that if a photogenerating component is used, the particles are processed down to a size to allow the thin film to be about 0.2 microns or smaller in thickness. The photogenerating component particles can be processed using techniques such as, for example, shaking or rolling a photogenerating component dispersion with steel or other hard material ball as set forth in, for example, U.S. Pat. No. 6,190,818, incorporated herein by reference.

The combination of a photogenerating component with electron transport molecules provides additional photoelectroactive sensitivity over merely the sensitivity of either the photogenerating component or electron transporting functional component alone. Most photoelectroactive photogenerating components have smaller ionization potentials than molecular hole transporters. For example, the difference in ionization potentials of N,N'-diphenyl-N,N'-di(m-totyl)-p-benzidine (mTDB) (a molecular hole transporting functional component), and metal-free phthalocyanine (a photogenerating component), is about 0.1 to about 0.2 eV. However, typically electron transporting functional components have high electron affinities, which favors electron transfer from the photoexcited photogenerating component and provides a sensitization pathway through the thin film.

In exemplary embodiments of the present invention, a bipolar transporting material is produced by thoroughly mixing the hole and electron transporting functional components together and dissolving the subsequent bipolar transport material in a common polymer binder. The photogenerating component is then added to the bipolar transport material and binder, and thoroughly mixed until homogeneous.

As the common polymer binder, an electrically inactive resin binder such as polycarbonate resin, polyester, polyarylate, polyacrylate, polyether, polysulfone, and the like, with weight average molecular weights varying from about 20,000 to about 150,000. It is further indicated that preferred binders include polycarbonates such as poly(4,4'-isopropylidene-diphenylene)carbonate (bisphenol-A-polycarbonate), poly(4,4'-cyclohexylidinediphenylene) carbonate (referred to as bisphenol-Z polycarbonate and/or PCZ200), polyvinyl butyral (PVB) and the like.

Conventional polycarbonate binder resins for charge transport layers have required the use of methylene chloride as a solvent in order to form a coating solution, for example, that renders the coating suitable for application via dip coating. However, methylene chloride has environmental concerns that require this solvent to have special handling and results in the need for more expensive coating and clean-up procedures. In exemplary embodiments of the present invention, a solvent system is used that is more environmentally friendly than methylene chloride, thereby enabling the thin film to be formed less expensively than with conventional polycarbonate binder resins. A preferred solvent system for use with the uniform thin film material of the present invention is tetrahydrofuran (THF) or n-butyl acetate (BuAc). Other solvents may also be present, if desired, such as toluene and the like.

In exemplary embodiments of the present invention, the thin film layer includes about 10 to about 90 weight percent electrically inactive resin binder, about 20 to about 80 weight percent of the hole transporting functional material and the electron transporting functional material, about 1 to about 15 weight percent photogenerating component. Preferably, the thin film layer includes about 30 to about 50 weight percent electrically inactive resin binder, about 40 to about 65 weight percent of hole transporting functional component and the electron transporting functional component, about 2 to about 10 weight percent photogenerating component.

Preferred ratios of hole transporting functional material to electron transporting functional material vary depending on the combination of molecules, and thus may include the following weight ratios optimized for best bipolar transport and best device sensitivity to light, e.g., (1) 4:1 AE18:BCFM, (2) 4:1 AE18:2EHCFM, (3) 3:2 TTA:NTDI, and (4) 3:1.7:(0.2–0.3) TTA:NQN:DPQ.

The solution coatable uniform thin layer is coated on any substrates and/or electrodes of an optoelectronic devices. An overcoat layer, for example, a second electrode, is then positioned on top of the thin layer. In exemplary embodiments, the substrate comprises aluminized MYLAR® or aluminized glass.

In exemplary embodiments, the uniform thin film is spin coated on the substrate. The spin coating is preferably conducted with from about 10% to 20% solids content at about 500 to about 3,000 revolutions per minute. More preferably, the spin coating is conducted using about 15% solid content at about 1,500 to about 2,500 revolutions per minute.

The uniform thin coat can be optionally overcoated with semitransparent gold electrodes.

The uniform thin coat can be used as the active component of organic optoelectronic devices including a modulator, photodetector, photoreceptors, photodiodes, photodiode sensors, photovoltaic cells, light emitting devices (LEDs), electroluminescent devices, and the like.

A number of examples are set forth herein below and are illustrative of different compositions and conditions that can be utilized in practicing embodiments of the present invention. All proportions are by weight unless otherwise indicated. It will be apparent, however, that the invention may be practiced with many different types and amounts of compositions and can have many different uses in accordance with the disclosed above and as pointed out hereinafter.

EXAMPLE I

A combination of about 17 wt % carboxyphenylnaphthaquinone (NQN), about 3 wt % t-butyl diphenoquinone (DPQ) and about 26 wt % N,N'-diphenyl-N,N'-di(m-totyl)-p-benzidine (mTDB) is dissolved in a solvent of tetrahydrofuran (THF) and then added to a solution of about 49 wt % bisphenol-Z polycarbonate (PCZ200) in tetrahydrofuran. The solution is thoroughly mixed and a 5 wt % dispersion of metal-free phthalocyanine is added to the matrix. The mixture is again thoroughly mixed and then spin-coated onto a substrate of aluminized MYLAR®.

EXAMPLE II

A combination of about 17 wt % carboxyphenylnaphthaquinone (NQN), about 3 wt % t-butyl diphenoquinone (DPQ) and about 26 wt % tri-p-tolylamine (TTA) is dissolved in a solvent of tetrahydrofuran (THF) and then added to a solution of about 49 wt % bisphenol-Z polycarbonate (PCZ200) in tetrahydrofuran. The solution is thoroughly mixed and 5 wt % dispersion of metal-free phthalocyanine is added to the matrix. The mixture is again thoroughly mixed and then spin-coated onto a substrate of aluminized MYLAR®.

The Figure is a graph of current versus voltage of a uniform thin film of Example II having a gold top electrode. The efficiency of the uniform thin film is $10^{-3}$ in white light.

EXAMPLE III

A combination of about 20 wt % NTDI and about 26 wt % N,N'-diphenyl-N,N'-di(m-totyl)-p-benzidine (mTDB) is dissolved in a solvent of tetrahydrofuran (THF) and then added to a solution of about 49 wt % bisphenol-Z polycarbonate (PCZ200) in tetrahydrofuran. The solution is thoroughly mixed and 5 wt % dispersion of metal-free phthalocyanine is added to the matrix. The mixture is again thoroughly mixed and then spin-coated onto a substrate of aluminized MYLAR®.

EXAMPLE IV

A combination of about 20 wt % NTDI and about 26 wt % N,N'-diphenyl-N,N'-di(m-totyl)-p-benzidine (mTDB) is dissolved in a solvent of n-butyl acetate and then added to a solution of about 49 wt % polyvinyl butyral (PVB) type B79 in n-butyl acetate. The solution is thoroughly mixed and 5 wt % dispersion of metal-free phthalocyanine. The mixture is again thoroughly mixed and then spin-coated onto a substrate of aluminized MYLAR®.

EXAMPLE V

A matrix is formed by mixing four parts of AE-18 with 1 part BCFM or 2EHCFM in a solvent of tetrahydrofuran (THF) and then added to a solution of about 49 wt % bisphenol-Z polycarbonate (PCZ200) in tetrahydrofuran. To this solution, about 2 wt % of dispersion of metal-free phthalocyanine is added, mixed and then spin coated onto a substrate of aluminized glass plates.

EXAMPLE VI

A matrix is formed by mixing four parts of AE-18 with 1 part butylcarboxylate fluorenone malononitrile (BCFM) or 2EHCFM in a solvent of tetrahydrofuran (THF) and then added to a solution of about 49 wt % bisphenol-Z polycarbonate (PCZ200) in tetrahydrofuran. To this solution, about 10 wt % of dispersion of metal-free phthalocyanine is added, mixed and then spin coated onto a substrate of aluminized glass plates.

It should be noted that in the above examples, no attempts were made to treat either the substrates and/or the electrodes, or to seal the prepared devices in any way. Further, none of the above materials were further purified beyond the condition received by the manufacturer. It is expected that purification of the substrates, electrodes and other materials of exemplary embodiments of the present invention will improve the efficiency of the product.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention.

What is claimed is:

1. A solution coatable thin film comprising a binder having uniformly dispersed therein at least one of each of:

a hole transporting functional component;

an electron transporting functional component; and a photogenerating component, wherein the hole transporting functional component and the electron transporting functional component together comprise about 20 to about 80 weight percent of the thin film, and wherein the thin film has a thickness of about 0.2 microns or less.

2. The solution coatable thin film according to claim 1, wherein the hole transporting functional component is selected from the group consisting of N,N'-diphenyl-N,N'-di(m-totyl)-p-benzidine), tri-p-tolylamine, N,N'-diphenyl-N,N'-bis(3-methylphenyl)-1,1'-biphenyl-4,4'-diamine, a triphenylamine hole-transferring material, and mixtures thereof.

3. The solution coatable thin film according to claim 1, wherein the electron transporting functional component is selected from the group consisting of carboxyphenylnaphthaquinone (NQN), t-butyl diphenoquinone (DPQ), TNF, DBTNF, DMDB, NTDI, butylcarboxylate fluorenone malononitrile (BCFM), 2-ethylhexylcarboxylate fluorenone malononitrile (2EHCFM), 1,1-(N,N'-bisalkyl-bis-4-phthalimido)-2,2-biscyano-ethylenes (BIB-CNs), and mixtures thereof.

4. The solution coatable thin film according to claim 1, wherein the photogenerating component is a photogenerating pigment, photogenerating dye, or a mixture thereof.

5. The solution coatable thin film according to claim 1, wherein the photogenerating component is selected from the group consisting of a dispersion of metal-free phthalocyanine, titanyl phthalocyanine (TiOPc), hydroxygallium phthalocyanine (OHGaPc), chlorogallium phthalocyanine (ClGaPc), benzimidazole perylene (BZP), and mixtures thereof.

6. The solution coatable thin film according to claim 1, further comprising an electronically inactive resin binder.

7. The solution coatable thin film according to claim 6, wherein the electrically inactive resin binder is selected from the group consisting of polycarbonate resin, polyester, polyarylate, polyacrylate, polyether, and polysulfone, having weight average molecular weights of from about 20,000 to about 150,000.

8. The solution coatable thin film according to claim 6, wherein the electrically inactive resin binder is selected from the group consisting of poly(4,4'-isopropylidene-diphenylene)carbonate (bisphenol-A-polycarbonate), poly(4,4'-cyclohexylidinediphenylene) carbonate (bisphenol-Z polycarbonate), polyvinyl butyral (PVB) and mixtures thereof.

9. The solution coatable thin film according to claim 1, wherein the hole transporting functional component and the electron transporting functional component are dissolved in a solvent comprising tetrahydrofuran (THF) or n-butyl acetate (BuAc).

10. The solution coatable thin film according to claim 1, wherein the photogenerating component comprises about 2 to about 10 weight percent of the thin film.

11. An optoelectronic device comprising the solution coatable thin film of claim 1 and a substrate.

12. The optoelectronic device according to claim 11, wherein the substrate includes an electrode.

13. The optoelectronic device according to claim 11, wherein the thin film is spin coated on the substrate.

14. A process of making a solution coatable thin film, comprising:

mixing at least one hole transporting functional component, at least one electron transporting functional component, at least one solvent, at least one electrically inactive resin binder, and at least one photogenerating component to form a solution;

and coating the solution onto a substrate to form the thin film having the at least one hole transporting functional component, the at least one electron transporting functional component, and the at least one photogenerating component uniformly dispersed therein, wherein the hole transporting functional component and the electron transporting functional component together comprise about 20 to about 80 weight percent of the thin film, and wherein the thin film has a thickness of about 0.2 microns or less.

15. The process according to claim 14, wherein the hole transporting functional component is selected from the group consisting of N,N'-diphenyl-N,N'-di(m-totyl)-p-benzidine), tri-p-tolylamine, N,N'-diphenyl-N,N'-bis(3 -methylphenyl)- 1,1'-biphenyl-4,4'-diamine, a triphenylamine hole-transporting functional component, and mixtures thereof, and the electron transporting functional component is selected from the group consisting of carboxyphenylnaphthaquinone, t-butyl diphenoquinone, TNF, DBTNF, DMDB, NTDI, butylcarboxylate fluorenone malononitrile, 2-ethyihexylcarboxylate fluorenone malononitrile, 1,1-(N,N'-bis-alkyl-bis-4-phthalimido)-2,2-biscyano-ethylenes, and mixtures thereof.

16. The process according to claim 14, wherein the photogenerating component is a photogenerating pigment, a photogenerating dye, or mixtures thereof.

17. A xerographic device comprising an organic optoelectronic device comprising solution coatable thin film having uniformly dispersed therein at least one of each of a hole transporting functional component, an electron transporting functional component, and a photogenerating component, wherein the hole transporting functional component and the electron transporting functional component together comprise about 20 to about 80 weight percent of the thin film, and wherein the thin film has a thickness of about 0.2 microns or less.

* * * * *

UNITED STATES PATENT AND TRADEMARK OFFICE

CERTIFICATE OF CORRECTION

PATENT NO. : 7,056,632 B2
APPLICATION NO. : 10/347231
DATED : June 6, 2006
INVENTOR(S) : Andronique Ioannidis It is certified that error appears in the above-identified patent and that said Letters Patent is hereby corrected as shown below:

Cover Page, section (73) (Xerox Corporation), change "Corporatioin" to --Corporation--.

Signed and Sealed this

Eighth Day of August, 2006

JON W. DUDAS
*Director of the United States Patent and Trademark Office*